United States Patent [19]

Dompas et al.

[11] 4,092,155

[45] May 30, 1978

[54] MACHINES FOR THE CASTING OF METALS

[75] Inventors: John M. Dompas, Olen, Belgium; Charles J. Petry, Winooski, Vt.

[73] Assignee: Metallurgie Hoboken-Overpelt, Brussels, Belgium

[21] Appl. No.: 489,655

[22] Filed: Jul. 18, 1974

[30] Foreign Application Priority Data

Jul. 25, 1973 France ..... 73 27166

[51] Int. Cl.[2] ..... C22C 38/50

[52] U.S. Cl. ..... 75/124; 75/123 M; 75/128 T; 75/126 D; 148/36; 164/429

[58] Field of Search ..... 164/278; 148/36; 75/123 M, 126 D, 128 T, 124

[56] References Cited

U.S. PATENT DOCUMENTS

| | | | |
|---|---|---|---|
| 3,853,639 | 12/1974 | Hughes | 148/36 X |
| 3,909,250 | 5/1974 | Jasper | 75/124 |

FOREIGN PATENT DOCUMENTS

| | | | |
|---|---|---|---|
| 1,254,871 | 11/1967 | Germany | 148/36 |

*Primary Examiner*—Arthur J. Steiner
*Attorney, Agent, or Firm*—Fred Philpitt

[57] ABSTRACT

A machine for the casting of metals having a moulding cavity formed by at least a moving casting belt and side dams, in which the said casting belt is made of mild killed steel containing between 0.2 and 0.8% by weight of titanium.

1 Claim, No Drawings

MACHINES FOR THE CASTING OF METALS

The present invention relates to a casting belt for machines for the continuous casting of metals, more particularly for machines for continuous casting, the molding cavity of which is formed by a pair of casting belts moving in a parallel direction and by two side dams ("side dams") separating said two belts, such as those made for example by Hazelett Strip-Casting Corporation, and those the moulding cavity of which is made by the groove of a wheel enclosed by a casting belt, such as those made by S.P.A. Continuous (Properzi) and by Southwire Company.

The casting belt according to the present invention is particularly well suited for the casting of metals having a high melting point such as copper and steel.

Up to now casting belts have been made of mild killed steels, that is steels having a low content of carbon (less than 0.2% by weight), free from special elements which have been added, and which have been deoxidized for instance with silicon, manganese or aluminium.

These known casting belts present the drawback of becoming rapidly worn when used for the casting of metals having a high melting point such as copper or steel.

In order to avoid that drawback, it has already been proposed to protect the surface of the casting belt which comes into contact with the molten metal, with an insulating coating which acts as a thermal barrier between the casting belt and the molten metal. When casting belts which have been subjected to such a treatment are used in a casting machine, the output of the casting machine is substantially reduced.

The casting belt according to the present invention avoids the drawbacks of the casting belts of the prior art.

The casting belt according to the present invention is made of mild killed steel to which 0.2 to 0.8% by weight of titanium has been added. Preferably the titanium content of the steel will be 0.4% by weight. The carbon content of the steel will preferably be lower than 0.1% by weight, and the steel will preferably have been killed with aluminium. The steel will advantageously be used in the cold-rolled stated.

A particularly well-suited steel contains in % by weight less than 0.03 phosphorus, less than 0.03 sulphur, 0.06 carbon, 0.02 to 0.05 aluminium, 0.15 to 0.4 manganese, 0.07 to 0.11 chromium, less than 0.002 silicon, 0.03 to 0.05 nickel, 0.4 titanium, and the balance iron, this steel having a breaking strength of 60 to 90 kg/mm$^2$ and an elongation of rupture of 2 to 15%.

A casting belt made of such a steel in a cold-rolled state, has a life of about fifteen hours when it is used for casting copper, whilst a casting belt made of steel without titanium but with substantially the same composition in the remaining elements as the above-mentioned steel has only a life of about five hours under similar casting conditions.

What we claim is:

1. A casting belt for machines for the casting of metals, said casting belt consisting of steel consisting essentially of in percent by weight less than 0.03 phosphorous, less than 0.03 sulphur, 0.06 carbon, 0.02 to 0.05 aluminum, 0.15 to 0.4 manganese, 0.07 to 0.11 chromium, less than 0.002 silicon, 0.03 to 0.05 nickel, 0.4 titanium, and the balance iron, and said steel has a rupture strength of 60 to 90 kg/mm$^2$ and an elongation of rupture of 2 to 15%.

* * * * *